United States Patent [19]

Peyrot et al.

[11] Patent Number: 4,683,656

[45] Date of Patent: Aug. 4, 1987

[54] RETRACTABLE BLADE KNIFE

[75] Inventors: Jean-Claude Peyrot; Jean-Louis Bonnard, both of Bordeaux, France

[73] Assignee: Preposreve S.A.R.L., France

[21] Appl. No.: 714,446

[22] Filed: Mar. 21, 1985

[51] Int. Cl.[4] ..... B26B 3/06

[52] U.S. Cl. ..... 30/162; 30/151; 30/2

[58] Field of Search ..... 30/162, 2, 151, 164, 30/335, 337, 125

[56] References Cited

U.S. PATENT DOCUMENTS 2,591,409 4/1952 Dahl ..... 30/162 X
3,943,627 3/1976 Stanley, Jr. .

FOREIGN PATENT DOCUMENTS 1264288 3/1968 Fed. Rep. of Germany .
2623490 12/1977 Fed. Rep. of Germany .
2350182 5/1977 France .
316033 3/1934 Italy ..... 30/162
1402853 8/1975 United Kingdom ..... 30/162

*Primary Examiner*—E. R. Kazenske
*Assistant Examiner*—Willmon Fridie, Jr.
*Attorney, Agent, or Firm*—Robert J. Koch

[57] ABSTRACT

A cutter type knife having a handle with a blade disposed to slide axially within the handle. Elements are provided for manually deploying the blade and automatically retracting the blade when a manual operating element is released. The manual operating element is a member adapted to be at least partially retracted into the handle. An additional part is adapted to convert movement of the aforementioned member into axial movement of the blade within the handle. In this way, retracting the aforementioned member deploys the blade. Also provide is a latch or lever for initially impeding retraction of the aforementioned member, whereby an initially greater force is required in order to begin retracting the member and thus deploy the blade.

6 Claims, 7 Drawing Figures

RETRACTABLE BLADE KNIFE

BACKGROUND OF THE INVENTION

1. Field of the Invention

The present invention relates to a cutter type knife with a blade which is retracted automatically as soon as the plunger, grip or trigger operated to deploy the blade from the handle is released.

2. Description of the Prior Art

Cutters of the above type are known comprising a sliding blade the deployment of which from the handle is commanded by pressing in a plunger on the side of the handle with the thumb, the plunger returning automatically to its initial position corresponding to total retraction of the blade as soon as the pressure exerted on it is removed, by virtue of a return spring disposed within the handle.

This type of instrument features two significant disadvantages. On the one hand, they do not offer a full guarantee of safety when not in use since they are not protected against unintentional partial deployment of the blade from the handle, which can be dangerous and result in injury, when the knife is in a pocket, for example.

On the other hand, they are not very easy to use since doing so requires a constant non-negligible pressure of the thumb on the plunger to hold the blade in the operative position. This is tiring in the long term and causes difficulties to lefthanded persons since the plunger is accessible from only one side of the handle of the knife.

An object of the present invention is to alleviate these disadvantages by proposing a system for automatically retracting the blade which is practical, efficacious and dependable under all circumstances.

SUMMARY OF THE INVENTION

The invention consists in a knife comprising a handle, a blade disposed to slide axially within said handle, manual operating means for deploying said blade, and means for retracting said blade when said manual operating means are released, wherein said manual operating means comprise a member adapted to be at least partially retracted into said handle, means adapted to convert movement of said member into axial displacement of said blade within said handle whereby retracting said member deploys said blade, and means for initially impeding retraction of said member whereby an initially greater force is required in order begin retracting said member.

In a first embodiment, said member comprises a trigger pivoted at one end to said handle whereby angular displacement of said trigger results in translational displacement of said blade.

In a second embodiment, said member comprises a plunger adapted to move in translation perpendicularly to the axis of said handle and parallel to the plane of said blade and comprising a wedge-shaped part adapted to enter said handle, said knife further comprising a fixed abutment member in said handle, a blade-carrier disposed to slide axially within said handle, said wedge-shaped part of said plunger being adapted to cooperate with said abutment member and said blade-carrier, and spring-loaded means adapted to urge said plunger and said blade-carrier into respective non-operated positions.

A knife of this kind is safer because of the initial impediment to retracting the plunger or trigger, which may have a latching effect, and which in practice prevents unintentional deployment of the blade by accidental snagging or pressure operating the plunger or trigger.

Moreover, the knife in accordance with the invention is particularly easy and efficacious to use without fatigue by virtue of the fact that the deployment of the blade is obtained by the pressure of the fingers or the palm of the hand, grasping the knife in the hand simultaneously bringing about full and effortless deployment of the blade and perfect holding of and pressure on the knife.

Other objects and advantages will appear from the following description of examples of the invention, when considered in connection with the accompanying drawings, and the novel features will be particularly pointed out in the appended claims.

DESCRIPTION OF THE PREFERRED EMBODIMENTS

Figure 3:
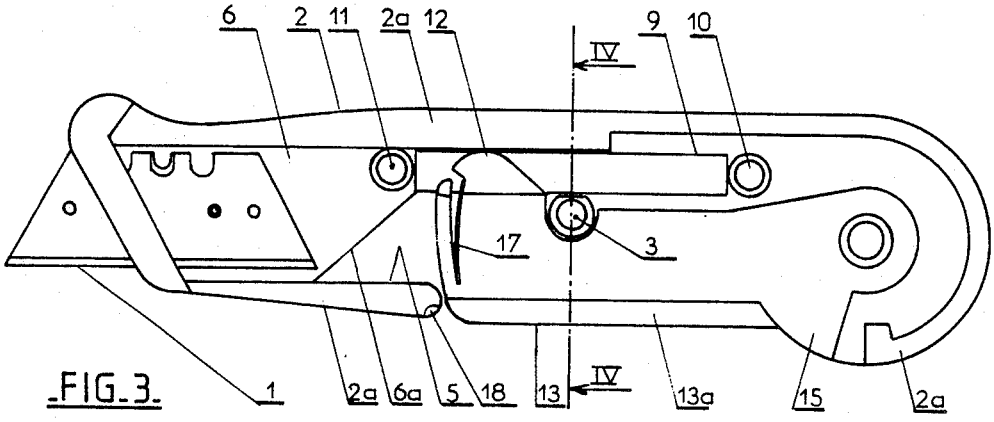
FIG. 3 shows the knife of FIG. 1 in an operative position with the trigger completely depressed.
Figure 2:
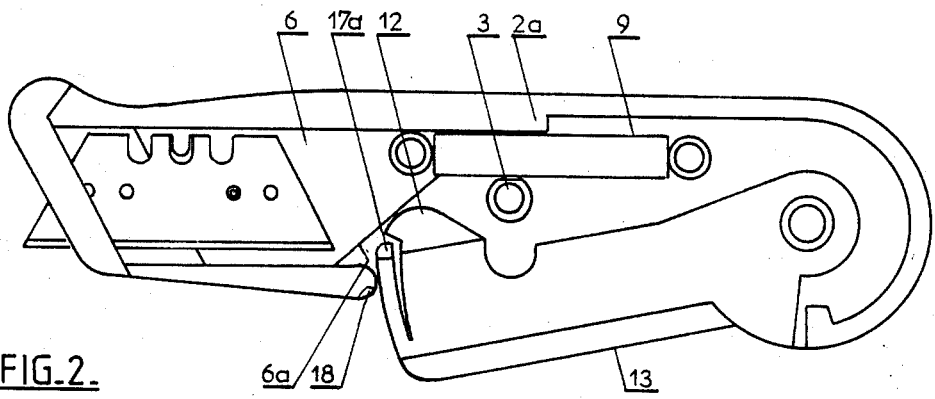
FIG. 2 shows the knife of FIG. 1 with the trigger depressed substantially halfway.
Figure 1:
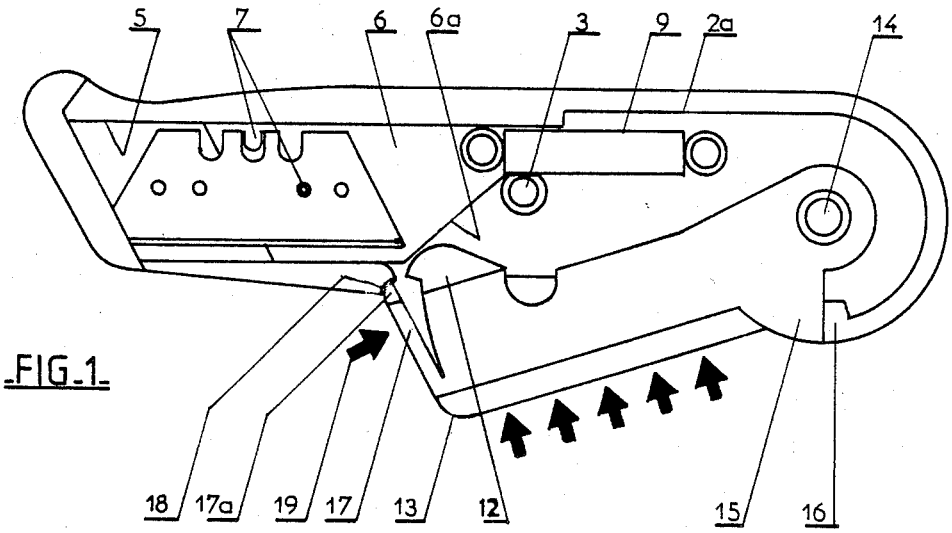
FIG. 1 is a schematic representation in longitudinal vertical cross-section of a knife in accordance with the invention in an inoperative position.
Figure 4:
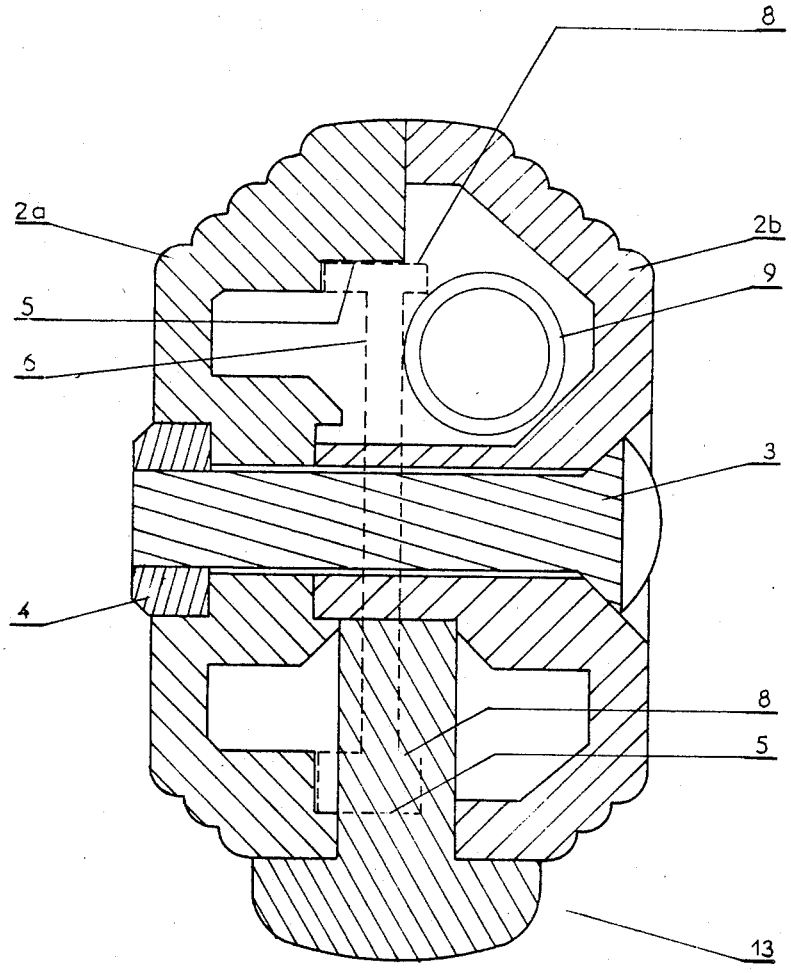
FIG. 4 shows the knife of FIG. 3 in cross-section on the line IV—IV.

The knife shown in FIGS. 1 through 4 is a cutter of the type with a blade 1 retractable within a hollow handle 2 made up of two half-handles **2*a* and 2*b* fastened together by means of a bolt 3 and nut 4 passing through the central part of the handle 2. In FIGS. 1 through 3 the half-handle 2*b*** is removed.

The handle 2 defines in its forward part means 5 for accommodating the blade and guiding it axially in the handle, which blade is carried in the usual manner by a mobile sliding member 6.

The blade is positioned on the sliding member 6 by means of centering and abutment studs 7.

The sliding member 6 is of trapezoidal shape and is made up (FIG. 4) of a thin plate of I-shaped cross-section featuring flanges 8 guiding the sliding member 6 in two parallel guide grooves 5 formed between the two half-handles **2*a* and 2*b***.

The sliding member 6 may be moved between two end positions, one with the blade 1 deployed in the operative position (FIG. 3) and the other with the blade fully retracted into the handle (FIG. 1).

The sliding member 6 is automatically urged into the position with the blade 1 retracted by a helical spring 9 fastened at one end to a projection 10 fast with the half-handle **2*a* and at the other end to a projection 11 fast with the sliding member 6**.

The rear edge **6*a* of the sliding member is shaped as an inclined ramp surface adapted to cooperate with a plunger consisting of a boss 12 formed at the end of a lever or trigger 13 pivoted to the rear of the handle on a pivot 14**.

The trigger 13 is arranged so as to retract almost entirely inside the handle, into a space provided for this purpose between the two half-handles 2*a*, 2*b*.

In the position with the trigger 13 unoperated (FIG. 1), the trigger projects to the maximum from the handle and a projection 15 abuts against a retaining edge 16 formed in the handle. In this position the boss 12 is at one end of the inclined ramp surface 6*a* and the blade 1 is completely retracted into the handle.

When the trigger 13 is pressed by the fingers of the hand grasping the knife (or by the palm if the trigger 13 were disposed on the opposite side of the handle), the boss 12 presses on the ramp surface and forces the sliding member 6 outwardly against the force of the return spring 9. At the end of the travel of the trigger 13 (FIG. 3) the boss 12 has reached the other end of the ramp 6*a* and abuts against the opposite wall of the handle.

In this position the blade 1 is deployed to the maximum extent and the outside edge 13*a* of the trigger is substantially flush with the opening of the passage formed for the trigger in the handle.

In accordance with another characteristic of the device in accordance with the invention, the trigger 13 comprises a safety device operative in the unoperated position (trigger projecting from the handle to the maximum extent, FIG. 1), procuring an initial impediment to retraction travel of the trigger. This requires a momentary excess pressure on the trigger 13 in order to overcome the resistance of the impediment, following which the resistance to depression is due only to the spring 9. The force of this impediment may be greater or lesser and may preferably be such as to procure a latching effect so that a specific maneuver must be effected before it is possible to depress the trigger.

It is this latter variant which is shown in FIGS. 1 through 3. For this purpose, the end of the trigger 13 is provided with a resilient tang 17 directed towards the handle and having a rounded end 17*a* adapted to cooperate with a recess 18 formed at the edge of the opening of the passage for the trigger in the handle.

In the unoperated position (FIG. 1) the tang 17 bears through its end 17*a* on the recess 18 and prevents retraction of the trigger 13. To enable such retraction it is necessary to press (arrow 19) on the tang 17 to urge it towards the trigger and release its end 17*a* from the recess 18. Thus the tang 17 escapes from the recess 18 when the trigger 13 is pressed.

This preliminary action on the tang 17 may be exerted by the index finger of the hand grasping the knife.

Retraction of the trigger is not significantly impeded by the tang 17, which is arranged so as not to come into contact with the sliding member 6.

Many other systems for latching the trigger may be envisaged without departing from the scope of the invention.

Figure 6:
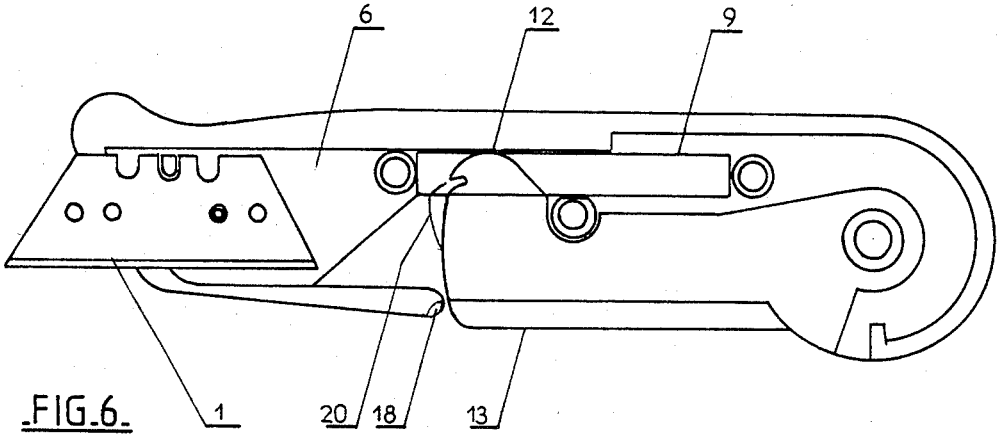
FIG. 6 shows the knife of FIG. 5 in an operative position with the trigger fully depressed.
Figure 5:
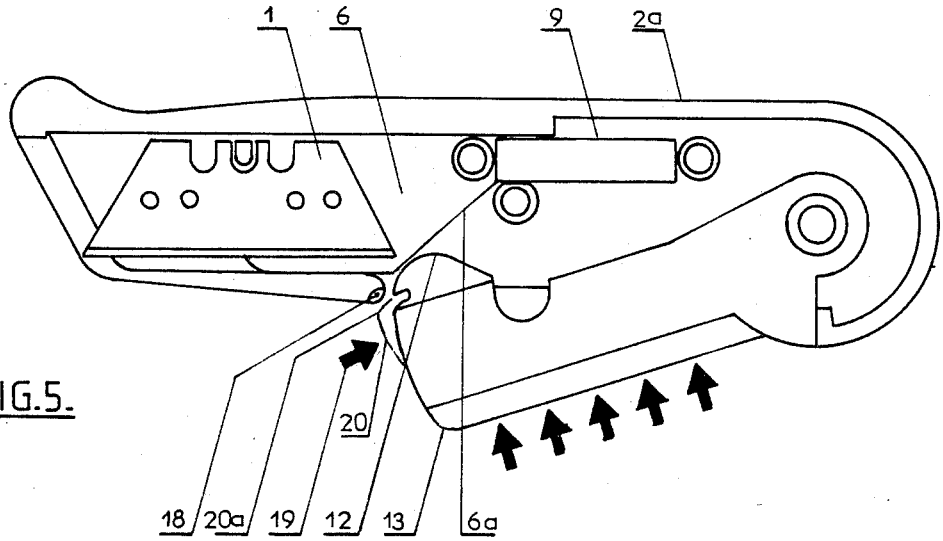
FIG. 5 is a schematic representation in longitudinal vertical cross-section of an alternative embodiment of a knife in accordance with the invention, in an inoperative position.

FIGS. 5 and 6 show an alternative embodiment of the resilient system of FIGS. 1 through 3 in which the tang 17, which may be molded at the same time as the trigger 13 from an appropriate plastics material, for example, is replaced by a curved leaf spring 20, fastened at one end to the trigger and having its curved free end 20*a* cooperating with a recess 18 analogous to that of FIGS. 1 through 3.

Figure 7:
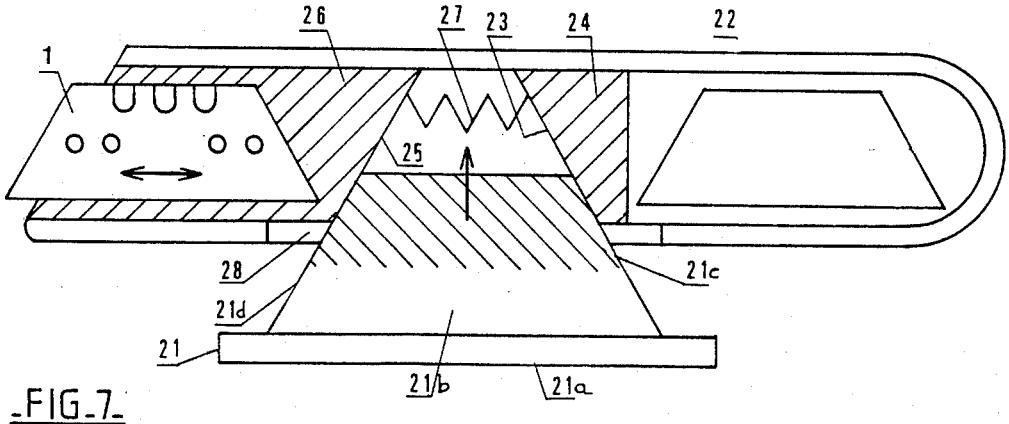
FIG. 7 is a schematic representation of a further embodiment.

FIG. 7 schematically represents another embodiment of a knife in accordance with the invention in which the member controlling displacement of the blade 1 consists of a plunger 21 partially engaged in the handle 22 and movable in translation perpendicular to the longitudinal axis of the handle.

The plane in which the plunger 21 moves is parallel to the plane of the blade, and to that in which the trigger 13 of the previous embodiments moves.

The plunger 21 comprises an outside part 21*a* and a part 21*b* adapted to enter the handle 22, in the form of a trapezoidal wedge of which the inclined rear flank 21*c* cooperates with a corresponding inclined surface 23 formed on a member 24 fixed to the inside of the handle.

The front inclined flank 21*d* of the wedge 21*b* cooperates with an inclined surface 25 of a blade-carrier 26 analogous to the blade-carrier 6 of the preceding embodiments.

A return spring 27 is disposed between the member 24 and the blade-carrier 26.

The plunger 21 moves in a passage 28 formed to this end in the wall of the handle 22.

Depressing the plunger 21 brings about partial deployment of the blade-carrier 26 against the action of the return spring 27.

Releasing the plunger 21 causes the return spring 27 to retract the blade-carrier 26 and pushes the plunger out of the handle, although it is of course retained therein by an abutment member (not shown).

This device may advantageously be provided with a safety latch for use in the non-operative position, of the type shown in FIGS. 1 and 5, or of a similar type.

The knife in accordance with the invention is thus absolutely safe when not in use, especially when in a pocket. It is particularly easy to hold and efficacious by virtue of the excellent grip it affords and the secureness with which it can be held in the operative position, due essentially to the fact that the operating member (13, 21) moves substantially in the median plane of the handle, parallel to the plane of the blade 1, and can thus be readily depressed by the fingers or palm of the hand.

It will be understood that various changes in the details, materials and arrangements of parts which have been herein described and illustrated in order to explain the nature of the invention may be made by those skilled in the art within the principle and scope of the invention as expressed in the appended claims. This applies in particular to the shape and arrangement of the trigger 13 or plunger 21 and the nature and arrangement of the means for latching the latter in the unoperated position.

There is claimed:

1. A knife comprising:

a handle;

a blade carrier disposed to slide axially within said handle, said blade carrier exhibiting an inclined rear edge;

a blade connected to said blade carrier;

manually operating means for axially deploying said blade, said manually operating means comprises an actuator to be at least partially retracted into said handle and means for cooperating with said inclined rear edge to convert movement of said actuator into axial displacement of said blade upon retracting said actuator into said handle, wherein said means for cooperating slides on said inclined rear edge upon movement of said actuator;

means for exerting a force to retract said blade into said handle wherein said force fully retracts said blade into said handle when less than a minimum operating force is exerted on said actuator;

means for impeding initial retraction of said actuator, associated with said manually operating means, wherein a force greater than said minimum operating force is required to initially retract said actuator when said blade is fully retracted into said housing.

2. A knife according to claim 1, wherein said actuator comprises a lever pivoted at a rear end to said handle whereby angular displacement of said lever results in translational displacement of said blade carrier.

3. A knife according to claim 1, wherein said actuator comprises a plunger adapted to move in translation perpendicularly to the axis of said handle and parallel to the plane of said blade, and wherein said means for cooperating is a wedge-shaped part adapted to enter said handle, said knife further comprising a fixed abutment member in said handle wherein said wedge-shaped part is adapted to cooperate with said abutment member and said blade-carrier.

4. A knife according to claim 1, wherein said means for impeding initial retraction of said actuator comprises latching means.

5. A knife according to claim 4, further comprising a recess in said handle and said latching means comprises a resilient tang fastened to said actuator and having an end part adapted to cooperate with said recess in said handle.

6. A knife according to claim 4, further comprising a recess in said handle and said latching means comprises a leaf spring fastened to said actuator and having an end part adapted to cooperate with said recess in said handle.

* * * * *